United States Patent [19]

Kleefeldt et al.

[11] Patent Number: 4,978,154

[45] Date of Patent: Dec. 18, 1990

[54] POWER-ACTUATED MOTOR-VEHICLE DOOR LATCH WITH ANTITHEFT FEATURE

[75] Inventors: Frank Kleefeldt, Heiligenhaus; Johannes T. Menke, Velbert; Ulrich Köstler, Unterschleissheim, all of Fed. Rep. of Germany

[73] Assignees: Kiekert GmbH & Co. Kommanditgesellschaft, Heiligenhaus; Bayerische Motoren Werke Aktiengesellschaft, Munich, both of Fed. Rep. of Germany

[21] Appl. No.: 389,834

[22] Filed: Aug. 4, 1989

[30] Foreign Application Priority Data

Aug. 13, 1988 [DE] Fed. Rep. of Germany ..... 3827610
Feb. 1, 1989 [DE] Fed. Rep. of Germany ..... 3902873

[51] Int. Cl.[5] ..... E05C 3/26
[52] U.S. Cl. ..... 292/201; 292/216
[58] Field of Search ..... 292/201, 216, 280, 341.16; 70/265

[56] References Cited

U.S. PATENT DOCUMENTS 4,135,377 1/1979 Kleefeldt et al. ..... 70/264
4,342,209 8/1982 Kleefeldt ..... 292/DIG. 25 X
4,669,283 6/1987 Ingenhoven ..... 292/201

FOREIGN PATENT DOCUMENTS 2911630 10/1982 Fed. Rep. of Germany .
3443287 6/1986 Fed. Rep. of Germany .

*Primary Examiner*—Richard E. Moore

*Attorney, Agent, or Firm*—Herbert Dubno; Andrew Wilford

[57] ABSTRACT

A motor-vehicle door latch for use on a vehicle door having inside and outside handles and inside and outside locking elements has a first housing part that contains a latch fork engageable in a locking position with a door bolt to retain same and lock the door, a lock pawl engageable in a retaining position with the fork to retain same in the locking position, an outside operating lever connected to the outside handle, an outside locking lever connected to the outside locking element, and an unlocking lever connected to the outside locking lever and operable to unlock the door. A second housing part contains an inside operating lever connected to the inside handle, an inside locking lever connected to the inside locking element, a coupling device pivoted coaxially with the inside locking lever and having one arm connected to the unlocking lever of the first housing part and another arm, and a central actuating unit. This unit includes an actuator, a spindle, a nut on the spindle displaceable between an unlock, a lock, and an antitheft position, and a slide displaceable jointly with the nut between the lock and unlock positions and connected to the other arm of the coupling device. An antitheft coupling is engageable between the nut, the coupling device, and the inside locking lever for coupling the inside locking lever to the coupling device and therethrough to the unlocking lever in the lock and unlock positions of the nut and for decoupling the inside locking lever from the coupling device in the antitheft position of the nut.

4 Claims, 8 Drawing Sheets

POWER-ACTUATED MOTOR-VEHICLE DOOR LATCH WITH ANTITHEFT FEATURE

FIELD OF THE INVENTION

The present invention relates to a motor-vehicle door latch. More particularly this invention concerns such a latch which has an antitheft feature and which is used with a central locking system.

BACKGROUND OF THE INVENTION

A standard door latch for a motor vehicle includes a housing mounted on the door edge and formed with a recess into which is engageable a bolt projecting from the respective door post. A fork is pivotal in the housing between a latching position engaging around the bolt and holding it solidly in the recess and a freeing position permitting the bolt to enter and leave the recess. A latch pawl engageable with the fork can hold it in the latched position. The latch pawl in turn is typically spring loaded and can be controlled via appropriate levers both from an inside door handle and an outside door handle, either of which can therefore operate the latch to allow the door to be opened.

In addition the door can be locked by means of a button or lever inside the door and a key cylinder outside the door, and also frequently by an actuator operated by a central lock system. When locked the outside door handle is either impeded from moving so it cannot move the latch pawl, or it is decoupled from the latch pawl so its actuation is ineffective.

In a standard lock system the inner door handle and inner lock button or lever remain effective even when the door is locked so that the outside handle does not work. In an antitheft system, however, there is, in addition to the locked and unlocked conditions of the latch, an antitheft mode or position in which the latch cannot be opened by either of the door handles and in which the inside lock element is also ineffective to unlock the door. Thus when in the antitheft position a would-be thief cannot even open the door by forcing the window and operating the door from inside.

As described in U.S. Pat. Nos. 4,342,209 of F. Kleefeldt and 4,669,283 of J. Ingehoven the antitheft position is set by an electric-motor actuator having a motor whose output shaft is a spindle on which is threaded a nut that acts as a detent that physically impedes and latches the inside lock element in the locked position. Thus the structure must be strong enough to withstand whatever force the would-be thief is willing to apply. Hence the elements must be made fairly robust and, therefore, are of expensive manufacture.

Another substantial disadvantage of the known antitheft systems is that the antitheft position is set by an actuator, typically an electric motor, and the latch can only be reset out of this antitheft position by means of this motor. Thus if the vehicle's electric power fails it becomes fairly impossible to enter the vehicle, even for someone with the right key that typically can operate the main central-lock switch. Similarly if the connection to a one of the latch actuators fails or one of the electric motors burns out, the respective latch can be left stuck in the antitheft position and painstaking disassembly of the door is required to effect the necessary repair.

SUMMARY OF THE INVENTION

A motor-vehicle door latch for use on a vehicle door having inside and outside handles and inside and outside locking elements according to this invention has a first or outside housing part and a second or inside housing part. The first part contains a latch fork engageable in a locking position with a door bolt to retain same and lock the door, a lock pawl engageable in a retaining position with the fork to retain same in the locking position, an outside operating lever connected to the outside handle, an outside locking lever connected to the outside locking element, and an unlocking lever connected to the outside locking lever and operable to unlock the door, The second part contains an inside operating lever connected to the inside handle, an inside locking lever connected to the inside locking element, a coupling device pivoted coaxially with the inside locking lever and having one arm connected to the unlocking lever of the first housing part and another arm, and a central actuating unit on the second housing part. This unit includes an actuator, a spindle, a nut on the spindle displaceable between an unlock, a lock, and an antitheft position, and a slide displaceable jointly with the nut between the lock and unlock positions and connected to the other arm of the coupling device. An antitheft coupling is engageable between the nut, the coupling device, and the inside locking lever for coupling the inside locking lever to the coupling device and therethrough to the unlocking lever in the lock and unlock positions of the nut and for decoupling the inside locking lever from the coupling device in the antitheft position of the nut.

Thus in this system the inside locking lever will merely be free to move between its lock and unlock position, without actuating any mechanism, when the device is in the antitheft position. On the other hand the outside locking lever can still be operated to override the antitheft setting and allow the door to be opened should the actuator or its power supply fail.

According to another feature of this invention a toggle spring is braced against the coupling device and defines therefore a pair of angularly offset end positions. An opposite spring bears against the inside locking lever and can be stronger or weaker than the toggle spring. When it is weaker an attempt to unlock the door from inside when the latch is in the antitheft position will leave the inside button in the unlock position indicating the attempt, and when it the inside-lever spring is stronger the button will snap back to the lock position if such an attempt is made.

In accordance with a further feature of this invention the coupling device is a lever unitarily formed with the arms. Furthermore the antitheft means includes a coupling lever coaxially pivoted with the coupling device and inside locking lever and having a radially displaceable entrainment formation. The inside locking lever is formed with a radial slot in which the formation is engaged and the lever of the coupling device is formed with a radially outwardly open notch into which the formation is engageable. An antitheft lever pivoted on the second housing part offset from the coupling lever has an arcuate slot generally centered on the pivot of the coupling device and an outer end continuously engaging the nut such that displacement of the nut into the antitheft position radially moves the formation out of the notch of the coupling-device lever.

DESCRIPTION OF THE DRAWING

The above and other objects, features, and advantages will become more readily apparent from the following, reference being made to the accompanying drawing in which.

SPECIFIC DESCRIPTION

Figure 1:
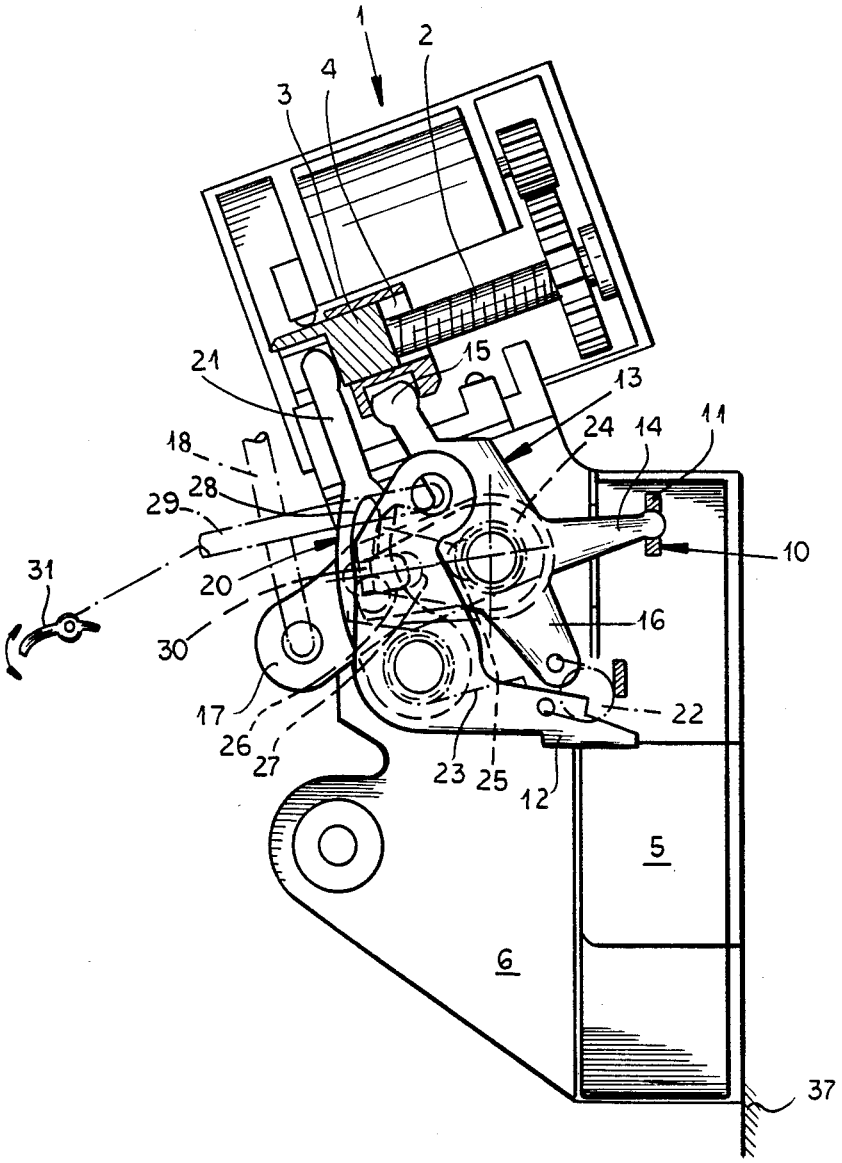
FIG. 1 is a partly sectional side view of the latch according to this invention in the antitheft position.
Figure 2:
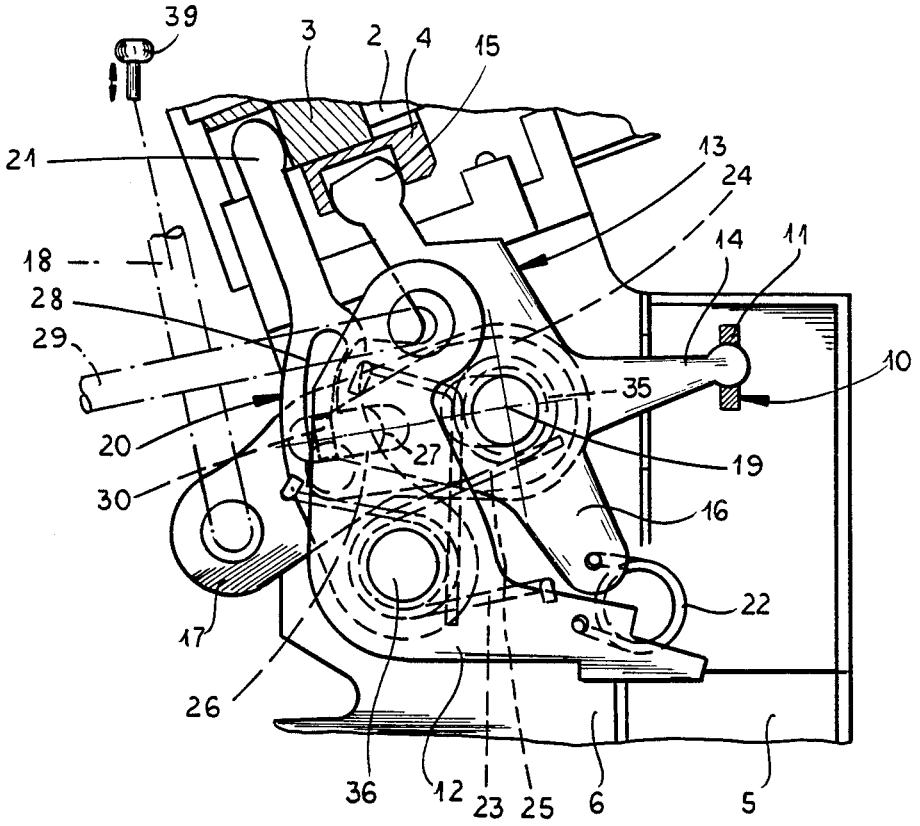
FIG. 2 is larger-scale view of a portion of FIG. 1.
Figure 3:
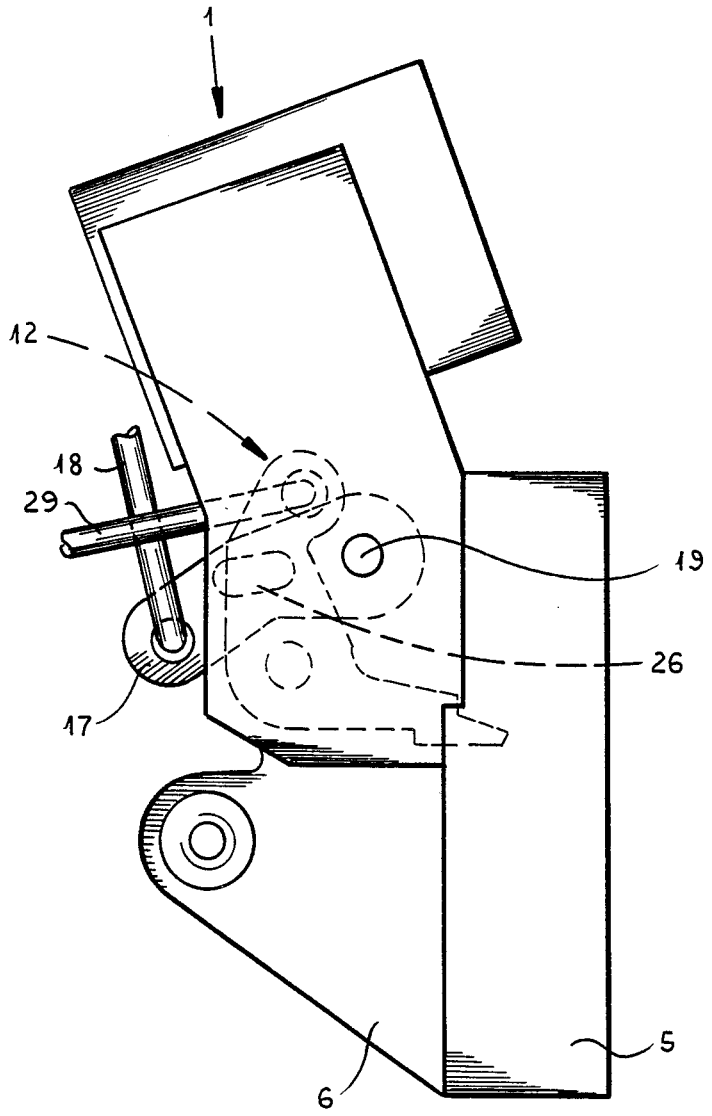
FIG. 3 is a side view of the latch also in the anti-theft position.
Figure 6:
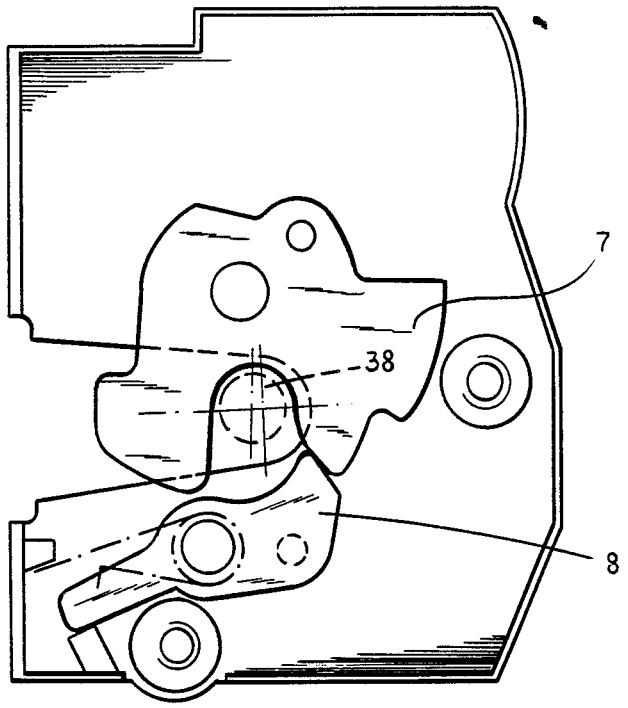
FIG. 6 is a rear side view of the latch.
Figure 7:
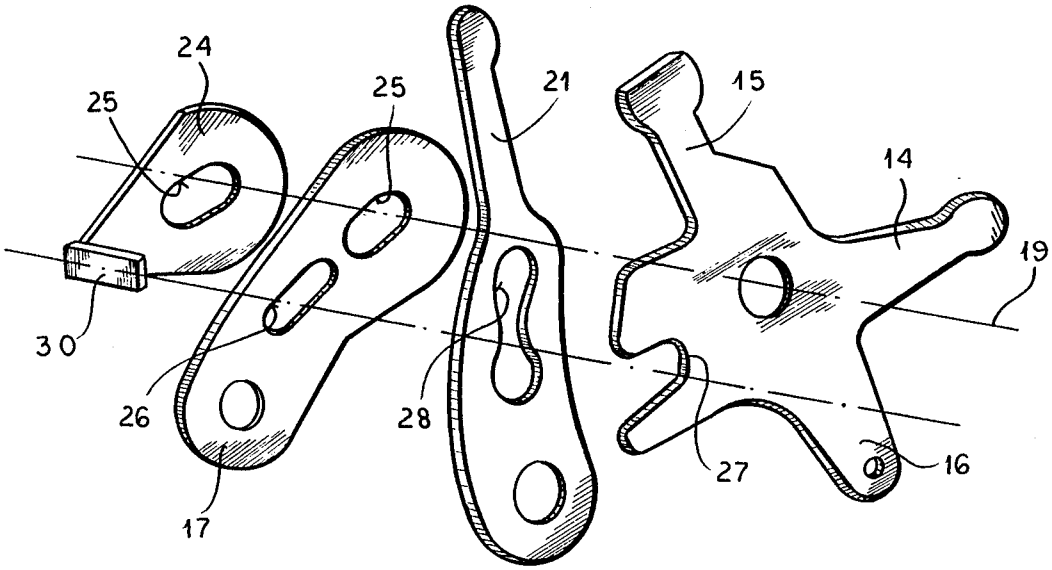
FIG. 7 is an exploded view of the main levers of the latch.
Figure 8:
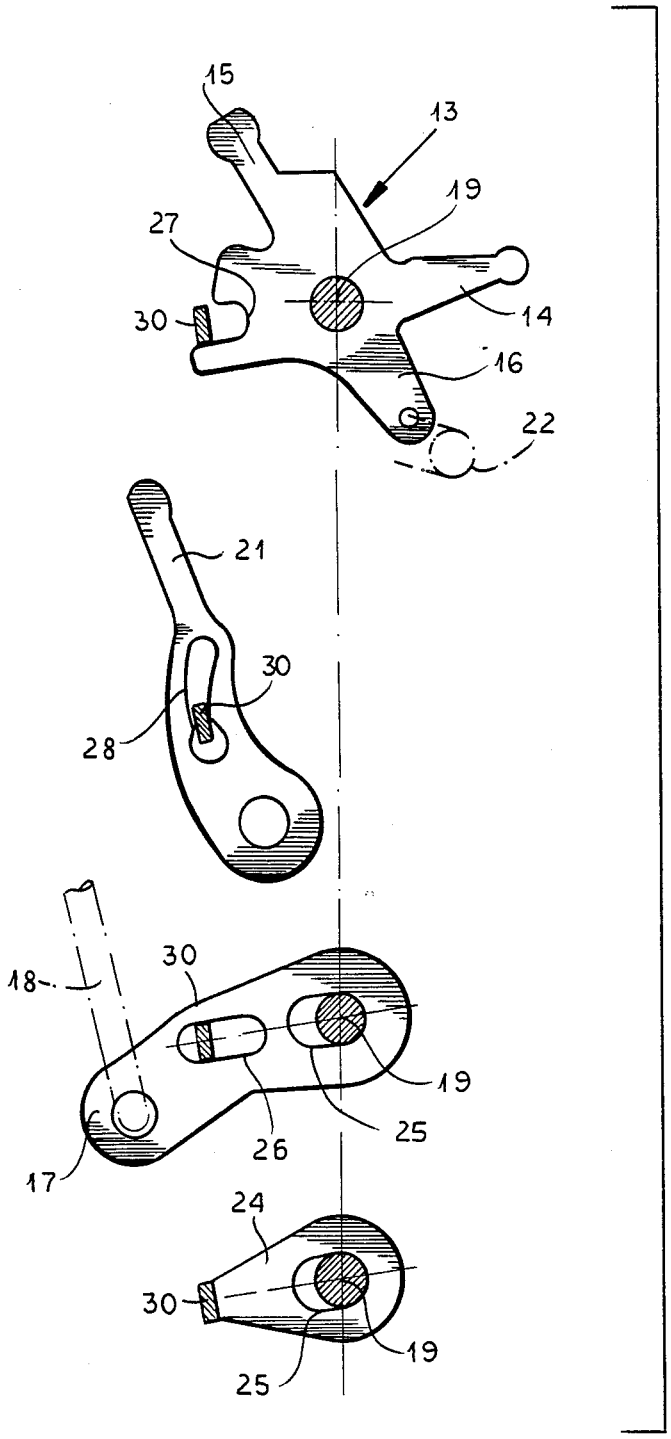
FIG. 8 is an end view of the main levers.

As seen in FIGS. 1, 2, and 6 a motor-vehicle door latch has a central lock actuator 1 having a threaded spindle 2 carrying a nut 3 connected via an unillustrated lost-motion coupling to a slide 4 in the manner described in some detail in the above-cited patents. The latch itself has two housing parts 5 and 6 extending generally at a right angle to each other. The part 5 carries the standard fork 7 and pawl 8 known per se, the latter being moved to release the fork 7 and open the latch by disengagement from a bolt shown schematically at 38 in FIG. 6.

Figure 4B:
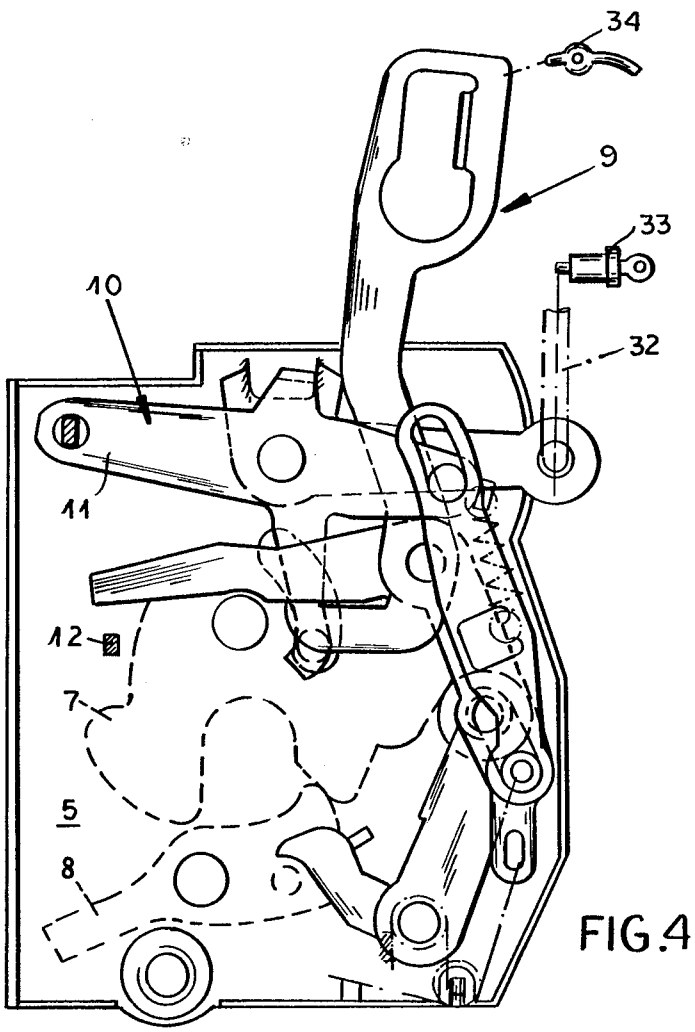
FIG. 4*b* is a section taken along a plane at a right angle to the section plane of FIG. 4*a* and showing the latch in the same position as in FIG. 4*a;*
Figure 5B:
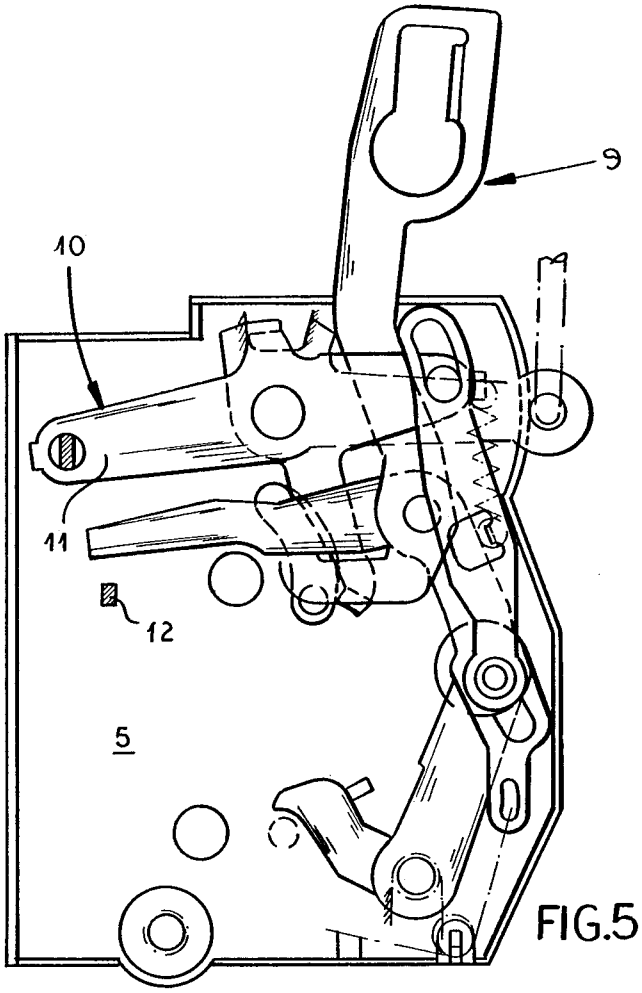
FIG. 5*b* is a section taken along a plane at a right angle to the section plane of FIG. 5*a* and showing the latch in the same position as in FIG. 5*a;*

An outside door handle 34 (FIG. 4*b*) is effective through a linkage 9 to unlatch the door, and an outside door cylinder 33 is effective via a rod 32 on a linkage 10 including an unlocking lever 11 that must be actuated to unlock the door shown schematically at 37. An inside door handle 31 is connected via a rod 29 to an inside operating lever 12 also, and an inside door button 39 is connected via a rod 18 to an inside latching lever 17. A coupling device or lever 13 has an arm 14 connected to the unlocking lever 11, and arm 15 fitted in the slide 4, and an arm 16 braced by a toggle spring 22. The unlocking lever 11 must be in the lowered position of FIG. 5*b* for the inside handle 31 or outside handle 34 to be effective on the pawl 8 to open the door.

A pivot bolt 19 in the housing part 6 carries the levers 13 and 17 as well as an antitheft lever 21 forming part of an antitheft coupling 20 and having an end engaged in the nut 3 and a coupling lever 24. The levers 17 and 24 are each formed with a slot 25 fitting over the pivot 19 and the lever 24 has an entrainment formation or finger 30 that fits through a slot 26 in the lever 17 and through another slot 28 in the lever 21, and that can engage in a notch 27 formed in the lever 13. The slot 26 extends radially of the pin 19 and is of the same width as the finger 30 so that in any radial position of this finger 30 the levers 17 and 24 are coupled. The slot 28 extends as an arc such that pivoting of the lever 21 on a pin 36 offset from the pivot 19 and also carrying the lever 12 will move the lever 24 and its finger 30 radially of the pivot 19. Only in an inner position does the finger 30 fit in the notch 27 of the lever 13 so that only in this position are the levers 17 and 13 coupled together by this finger 30 for joint rotation.

Figure 4A:
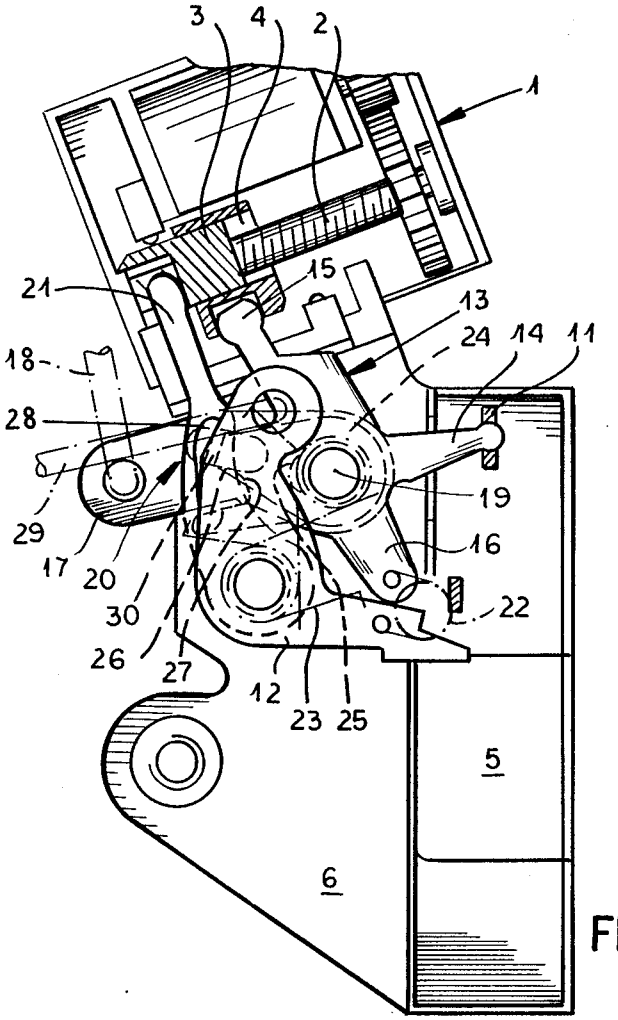
FIG. 4*a* is a view like FIG. 1 with the latch in the antitheft position and the inside locking mechanism acuated.

Thus according to this invention the nut 3 can move the lever 21 into a position pulling the coupling finger 30 so that the levers 17 and 13 are decoupled. This is the position shown in FIG. 4*a* where the lever 17 is also shown in the actuated position. Clearly in this antitheft position movement of this lever 17 is ineffective to operate the lever 11 via the arm 14 of the lever 13. Similarly the inside lever 12 is also rendered ineffective in the manner known per se.

Figure 5A:
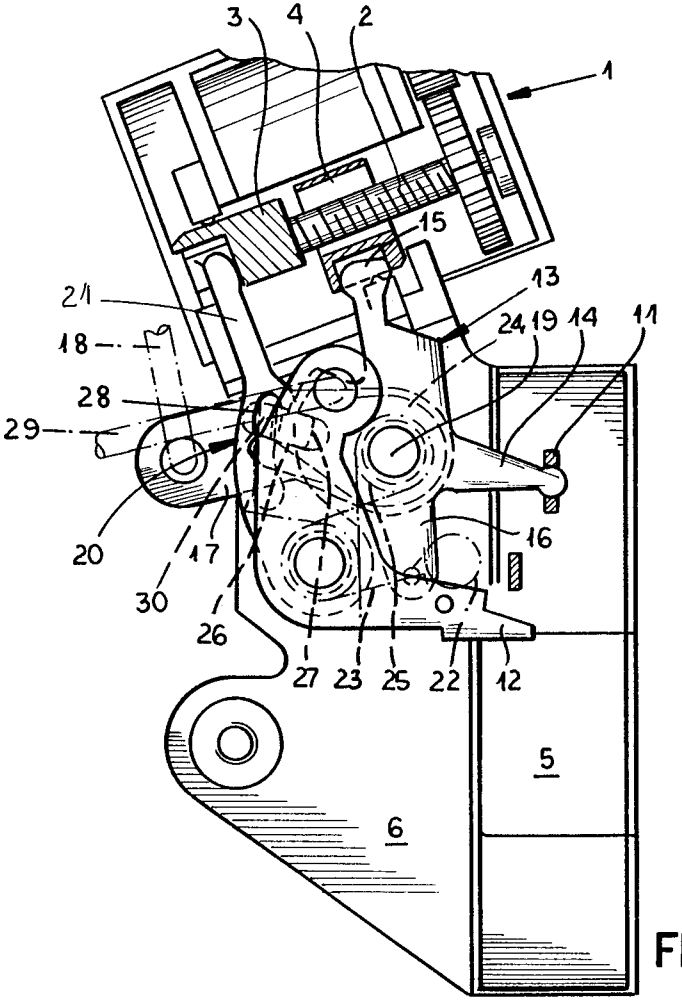
FIG. 5*a* is a view like FIG. 1 with the latch in the antitheft position and the outside locking mechanism actuated.

FIG. 5*a* shows how the outside cylinder 33 can move the connecting link 11 into the unlock position regardless of the setting at the actuator 1. Thus in the event of failure of the actuator 1 or its power supply it is possible to manually over-ride the antitheft setting and open the latch.

We claim:

1. A motor-vehicle door latch for use on a vehicle door having inside and outside handles and inside and outside locking elements, the latch comprising;

a first housing part;

a latch fork pivotal on the first part and engageable in a locking position with a door bolt to retain same and lock the door;

a lock pawl pivotal on the first part and engageable in a retaining position with the fork to retain same in the locking position;

an outside operating lever pivoted on the first part and connected to the outside handle;

an unlocking lever on the first part connected to the outside locking element and connected to the lock pawl, whereby operation of the unlocking lever can unlock the door;

a second housing part mounted on the first part;

an inside operating lever pivoted on the second part and connected to the inside handle;

an inside locking lever pivoted on the second part and connected to the inside locking element;

a coupling device pivoted coaxially with the inside locking lever and having one arm connected to the unlocking lever of the first housing part and another arm;

a central actuating unit on the second housing part and including an actuator, a spindle, a nut on the spindle displaceable between an un lock, a lock and an antitheft position, and a slide displaceable jointly with the nut between the lock and unlock positions and connected to the other arm of the coupling device; and antitheft coupling means engageable between the nut, the coupling device, and the inside locking lever for coupling the inside locking lever to the coupling device and therethrough to the unlocking lever in the lock and unlock positions of the nut and for decoupling the inside locking lever from the coupling device in the antitheft position of the nut.

2. The motor-vehicle door latch defined in claim 1 further comprising.

a toggle spring braced against the coupling device and defining therefore a pair of angularly offset end positions.

3. The motor-vehicle door latch defined in claim 2 wherein the coupling device is a lever unitarily formed with the arms.

4. The motor-vehicle door latch defined in claim 3 wherein the antitheft means includes:

a coupling lever coaxially pivoted with the coupling device and inside locking lever and having a radially displaceable entrainment formation, the inside locking lever being formed with a radial slot in which the formation is engaged and the lever of the coupling device being formed with a radially outwardly open notch into which the formation is engageable; and an antitheft lever pivoted on the second housing part offset from the coupling lever, having an arcuate slot generally centered on the pivot of the coupling device, and having an outer end continuously engaging the nut such that displacement of the nut into the antitheft position radially moves the formation out of the notch of the coupling-device lever.

* * * * *